US010893709B2

(12) United States Patent
van Oudenallen

(10) Patent No.: US 10,893,709 B2
(45) Date of Patent: Jan. 19, 2021

(54) GARMENT FOR PREVENTING REDISTRIBUTION HYPOTHERMIA

(75) Inventor: Robertus Gerardus van Oudenallen, Vleuten (NL)

(73) Assignee: The Surgical Company International B.V., Amersfoort (NL)

( * ) Notice: Subject to any disclaimer, the term of this patent is extended or adjusted under 35 U.S.C. 154(b) by 930 days.

(21) Appl. No.: 13/217,120

(22) Filed: Aug. 24, 2011

(65) Prior Publication Data

US 2012/0047622 A1 Mar. 1, 2012

Related U.S. Application Data

(60) Provisional application No. 61/376,824, filed on Aug. 25, 2010.

(51) Int. Cl.
*A61F 7/00* (2006.01)
*A41B 9/00* (2006.01)
(Continued)

(52) U.S. Cl.
CPC ..... *A41D 13/0025* (2013.01); *A41D 13/0051* (2013.01)

(58) Field of Classification Search
CPC .. A41D 13/00; A41D 13/005; A41D 13/0025; A41D 13/0053; A41D 13/1227; A41D 13/1245; A41D 13/0051; A41D 13/0125; A41D 13/018; A41D 13/1263; A41D 13/002; A41D 13/1254; A41D 31/0038; A41D 31/02; A61F 7/00; A61F 7/0097; A61F 7/032; A61F 2007/0039; A61F 2007/0041; A61F 2007/0055; A61F 2007/0233; A61F 2007/0236; A61F 2007/0257; A61F 2007/0258; A61F 2007/0273; B63C 9/105; B63C 9/1055;
(Continued)

(56) References Cited

U.S. PATENT DOCUMENTS 2,255,751 A * 9/1941 Bancel ..... A41D 13/0025 165/46
3,307,554 A * 3/1967 Thornton ..... A41D 13/0051 165/46
(Continued)

FOREIGN PATENT DOCUMENTS

DE 9104142 U1 * 9/1991 ..... A41D 13/0025
DE 4236160 5/1994
JP WO 2009008186 A1 * 1/2009 ..... A61H 9/0078

*Primary Examiner* — Jameson D Collier
(74) *Attorney, Agent, or Firm* — Nixon & Vanderhye, P.C.

(57) ABSTRACT

A thermal therapy garment that covers at least the lower extremities of a patient. The garment has an air impermeable outer layer and an air permeable inner layer. An inflatable air chamber is defined between the inner and outer layers. An inlet port connects to the chamber to allow inflation with conditioned air, which is exhausted through the inner layer over a selected region of the patient's lower body. A gown has a length sufficient to overlap a waist portion of the garment, The gown has an opening that coincides with the inlet port, thereby allowing a hose to pass through the gown and connect to the inlet port. In one embodiment, the gown has sleeves and/or a posterior portion that are heat reflective whereby the extremities are warmed to minimize the core to peripheral temperature gradient.

25 Claims, 5 Drawing Sheets

(51) Int. Cl.

| | |
|---|---|
| ***A41D 10/00*** | (2006.01) |
| ***A62B 17/00*** | (2006.01) |
| ***A62D 5/00*** | (2006.01) |
| ***A41D 13/002*** | (2006.01) |
| ***A41D 13/005*** | (2006.01) |

(58) Field of Classification Search

CPC ..... A61H 2205/10; A61H 2205/102; A61H 2205/106; A61H 2205/108; A62B 17/005

USPC ..... 219/211, 212, 527, 528, 545; 607/104, 607/107, 108, 114; 2/114, 227, 456, 458, 2/904

See application file for complete search history.

(56) References Cited

U.S. PATENT DOCUMENTS

| | | | | |
|---|---|---|---|---|
| 3,494,356 | A | 2/1970 | Melges | |
| 4,024,730 | A * | 5/1977 | Bell | A62B 7/14 128/202.13 |
| 4,146,933 | A * | 4/1979 | Jenkins | A41D 13/005 2/108 |
| 4,998,296 | A * | 3/1991 | Stames | 2/458 |
| 5,269,369 | A * | 12/1993 | Faghri | 607/104 |
| 5,383,918 | A * | 1/1995 | Panetta | 607/104 |
| 5,891,187 | A * | 4/1999 | Winthrop et al. | 607/96 |
| 5,980,561 | A | 11/1999 | Kolen et al. | |
| 6,409,745 | B1 * | 6/2002 | Ducharme et al. | 607/108 |
| 6,574,799 | B2 * | 6/2003 | Donaldson | 2/16 |
| 6,996,848 | B2 * | 2/2006 | Donaldson | 2/16 |
| 7,117,687 | B2 * | 10/2006 | Naaman | A41D 31/0038 62/259.3 |
| 7,819,911 | B2 * | 10/2010 | Anderson et al. | 607/107 |
| 8,043,350 | B2 * | 10/2011 | Anderson | 607/104 |
| 9,956,112 | B2 * | 5/2018 | van Oudenallen | A61F 7/02 |
| 10,398,589 | B2 * | 9/2019 | Van Oudenallen | A61F 7/0085 |
| 2002/0088788 | A1 * | 7/2002 | West | 219/211 |
| 2003/0041364 | A1 * | 3/2003 | Donaldson | 2/69 |
| 2006/0047332 | A1 * | 3/2006 | Malmberg et al. | 607/104 |
| 2006/0052853 | A1 * | 3/2006 | Augustine et al. | 607/104 |
| 2006/0174392 | A1 * | 8/2006 | Farnworth et al. | 2/102 |
| 2006/0184217 | A1 | 8/2006 | Van Duren | |
| 2007/0093885 | A1 | 4/2007 | Anderson et al. | |
| 2007/0239239 | A1 * | 10/2007 | Albrecht | A61F 7/00 607/96 |
| 2007/0289050 | A1 * | 12/2007 | Nocente | A41D 13/00 2/458 |
| 2008/0177361 | A1 * | 7/2008 | Anderson | A61F 7/0097 607/108 |
| 2009/0062891 | A1 * | 3/2009 | Bieberich | A61F 7/00 607/104 |
| 2012/0047623 | A1 * | 3/2012 | van Oudenallen et al. | 2/114 |

* cited by examiner

GARMENT FOR PREVENTING REDISTRIBUTION HYPOTHERMIA

CROSS-REFERENCE TO RELATED APPLICATIONS

This application claims the benefit of U.S. Provisional Application No. 61/376,824, filed Aug. 25, 2010.

STATEMENT REGARDING FEDERALLY SPONSORED RESEARCH OR DEVELOPMENT

Not Applicable

BACKGROUND

1. Field of Invention

This invention relates to a system for warming the body of a human to prevent redistribution hypothermia. More particularly, this invention pertains to passive warming and active warming before, during, and after surgery or other medical procedures without increasing the core to peripheral temperature gradient.

2. Description of the Related Art

Inflatable thermal blankets that are used to communicate a conditioned gas, such as heated or cooled air, to a patient are known in the art. Such thermal blankets typically have an inflatable portion provided with an inlet port for placing the inflatable portion in fluid communication with a source of pressurized, conditioned gas such that the inflatable portion can be selectively inflated. The inflatable portion generally has an inner surface that is positioned next to the patient. The inner surface is gas permeable or is otherwise adapted to communicate the conditioned gas used to inflate the blanket to the user. Such thermal blankets are often used to treat conditions such as hypothermia or used to reduce the body temperature of a user in circumstances where the body temperature is inappropriately high. For example, where a patient is being treated for hypothermia, at least a portion of the patient's body is covered with the thermal blanket, and warm air is pumped into the inflatable portion. The warm air used to inflate the inflatable portion is thereafter communicated through the inner surface of the inflatable portion so as to bath the body portion covered by the blanket in warm air. U.S. Patent Application Publication Number 2007/0093885, titled "Multifunction warming device with an upper body convective apparatus," is an example of medical warming devices that are representative of the art. The published application discloses a prior art blanket that fits over a prone patient and a thermal device inside a gown. Another representative example is U.S. Patent Application Publication Number 2006/0184217, titled "Warming device for perioperative use."

Generally, inflatable thermal blankets cover substantially the whole body of the patient or portions of the body when the patient is lying on a surface. Inflatable thermal devices that treat selected portions of the body are known. For example, U.S. Pat. No. 5,980,561, titled "Applying thermal therapy to living tissue" and issued to Kolen on Nov. 9, 1999, discloses a therapy pad that fits around a portion of a patient's leg. The therapy pad circulates conditioned water through a fluid loop in a pad configured to be positioned adjacent a body part. Such a pad is used to apply heat or cold to tissue to heal and rehabilitate injuries, such as, bruises, sprains, or other trauma to bone, muscle, ligaments, tendons, and skin.

In a medical environment, body conforming drapes are known. For example, U.S. Pat. No. 3,494,356, titled "Disposable obstetrical and surgical drapes" issued to Melges on Feb. 10, 1970, discloses a drape that fits around a leg of the patient lying on a table. The drape has a bag-shape configured to receive the leg of a patient. The drape disclosed in the Melges patent is a passive device and does not receive a conditioned fluid.

BRIEF SUMMARY

According to one embodiment of the present invention, a lower body garment for warming a patient that includes pants that enclose the legs is provided. The pants include an outer section and an inner section. The outer section includes a port, a torso portion and two leg portions extending distally from the torso portion to the feet. The inner section includes a torso portion and two leg portions extending distally from the torso portion to the feet. The outer section and the inner section are joined at the waist hem of the torso portion and at the distal end of each leg portion to form an enclosed region within the pants. The port of the outer section is configured to receive a nozzle from a hose. The leg portions of the inner section include a material for distributing the air within the pants. In one embodiment, the distributing material is air permeable. In another embodiment, the material includes perforations. The outer section includes an air impermeable material. The leg portions of the outer section and the inner section include releasable seams for accessing the legs of the patient.

In one embodiment, a gown encloses the patient's upper body and the torso portion of the lower body garment. The gown includes a body portion and two sleeves. The body portion encloses the torso and includes a neck opening and an opening for accessing the port of the pants. The sleeves extend from the body and enclose the arms. The sleeves and posterior portion of the gown include a heat reflective material. The anterior of the thorax, or chest, portion of the gown is non-reflective. The reflective coating (such as alumina) at the arms and back reduces the heat loss by radiation. The fabric at the thorax is uncoated to reduce the increase in core temperature due to the supplied heated air.

In one such embodiment, hand enclosures are provided for enclosing the hands of the patient. In one such embodiment, the hand enclosures include a heat reflective material. In another such embodiment, foot enclosures are provided for enclosing the feet of the patient. In one such embodiment, the foot enclosures include a heat reflective material.

The lower body garment and gown described herein focus on maintaining and controlling the temperature of the limbs to prevent redistribution hypothermia and for optimal heat storage in the patient's body. Forced air heated full body blankets are very effective in warming the limbs. However, no distinction is made between the thorax and the limbs. The heat flow to the thorax often leads to an increase of the core temperature and a reduction of comfort, and thus sweating. Furthermore, patient mobility is restricted by full body blankets.

The system operates to reduce the core-to-peripheral temperature gradient to prevent redistribution hypothermia, and also to increase the heat content of peripheral compartments (heat accumulation) to compensate for the heat loss during anesthesia.

One embodiment of the system includes a lower body garment and a gown. A blower and a hose connects to the lower body garment. Heat is supplied by heated forced air which is created in the blower. From the blower the heated, forced air is transferred to the lower body garment via a hose. The heated forced air enters the lower body garment in the waist portion. From the waist portion, the heated air is transferred to the legs. The heated air flows along the legs and leaves the lower body garment at the feet, and at the waist opening.

In one embodiment, the fabric of the lower body garment and the gown is bio-degradable.

Medical requirements for the lower body garment and gown prescribe that the heated air flowing through the gown must be above 36° C. to prevent hypothermia. Heated forced air is created in a compact blower with a high rpm fan and a heat exchanger. To prevent unintended cooling of the patient, the output temperature of the blower is adjusted to a range of 36-43° C. The patient can adjust the output volume flow of the blower manually to a comfortable level. The compact blower is supplied with a bed mounting mechanism. By means of an optional battery pack, the blower can be kept in operation while the patient is transported.

The lower body garment is supplied with a port at the front side waist level. The hose is connected through the port in the lower body garment.

The system provides effective heating of the legs and/or arms while maintaining a constant core temperature. Furthermore, the patient's freedom of movement is not restricted as with heated mattresses and blankets. Besides prewarming, the pants and gown provides patient warming during surgery and during postoperative warming. The seam at the back portion of the gown is openable such that the gown can be draped optimally during treatment.

BRIEF DESCRIPTION OF THE SEVERAL VIEWS OF THE DRAWINGS

The above-mentioned features will become more clearly understood from the following detailed description read together with the drawings in which.

DETAILED DESCRIPTION

A garment 100 for warming a patient and preventing redistribution hypothermia is disclosed. The garment 100 provides passive warming and active warming of patients before, during and/or after surgery or other medical procedures.

Figure 1:
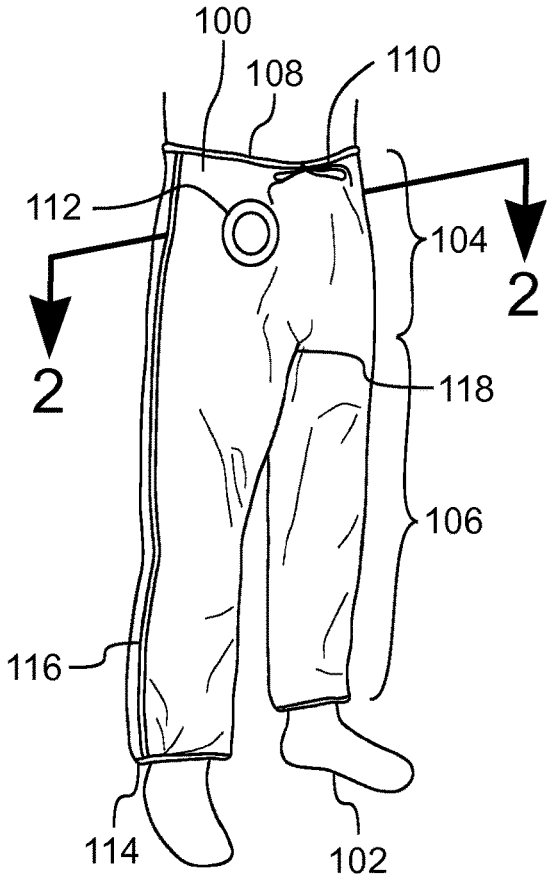
FIG. 1 is a perspective view of one embodiment of a warming garment worn by a patient who is standing.

FIG. 1 illustrates a perspective view of one embodiment of a garment 100 worn by a patient 102 who is standing. FIG. 1 shows the garment 100 in a first, or passive, configuration that is suitable for a patient 102 who is mobile. The first configuration allows the patient 102 to stand, walk, sit, or otherwise move or position himself. In the illustrated embodiment, the garment 100 is pants.

The garment 100 includes a waist portion 104, two leg portions 106, and two releasable openings 116. The waist portion 104 encloses a portion of the patient's abdomen. The waist portion 104 includes a waist hem 108, a fastener 110, and a port 112. The waist hem 108 defines an opening in the waist region of the garment 100. The fastener 110 secures the waist portion 104 around the abdomen of the patient 102. In the illustrated embodiment, the fastener 110 is a drawstring. In other embodiments, the fastener 110 includes straps, hook and loop fasteners, elastomeric material, buttons, snaps, and/or connectors that releasably secure the waist opening around the patient's abdomen. With the patient 102 in an upright or standing position, the garment 100 is supported by the fastener 110 that secures the garment 100 around the waist of the patient 102.

Proximate the waist hem 108 of the garment 100 is a port 112. The port 112 provides access to an opening in the anterior waist portion 104 of the garment 100. The port 112 includes a collar with an opening to receive a nozzle of a hose. The port 112 is fastened to the garment 100 at the opening to provide an air tight seal. In one embodiment, the collar of the port 112 is fastened to the garment 100 by heat welding. In another embodiment, the collar of the port 112 is fastened to the garment 100 by gluing.

The leg portions 106 of the garment 100 extend distally toward the feet of the patient 102. In the illustrated embodiment, the leg portions 106 extend as far as the ankles of the patient 102. The feet of the patient 102 extend through an opening in each respective leg portion 106. The opening in the respective leg portion 106 is defined by a leg hem 114, which is the distal end of each respective leg portion 106. In one embodiment, the leg hems 114 include an elastomeric material, such as an elastic band, to elastically reduce the size of the opening. The elastic band maintains the leg hem 114 snugly against the leg. In other embodiments, the leg hems 114 include drawstrings, adhesive tape, hook and loop fasteners and/or connectors that releasably secure the leg hem 114 around the leg to a desired level of closure and/or openness. The leg portions 106 enclose a portion of the lower extremities of the patient 102 without hindering the mobility of the patient 102 when the patient 102 is walking or otherwise moving about.

In one embodiment, a releasable opening 116 extends distally along each lateral portion of the garment 100 from the waist hem 108 to the leg hem 114. Each releasable opening extends distally from the waist hem 108, along a lateral portion of the waist portion 104, along a lateral portion of a leg portion 106, to a leg hem 114. The releasable opening 116 provides access to the legs of the patient 102. For example, the releasable opening 116 is used to place the garment 100 on or to take the garment 100 off a prone patient 102. In another embodiment, the releasable opening extends from the distal end of the garment 100 for only a portion of its length. In yet another embodiment, the releasable opening 116 extends along the inside seam from one leg hem 114, up through the crotch region 118, and down to the other leg hem 114.

Figure 2:
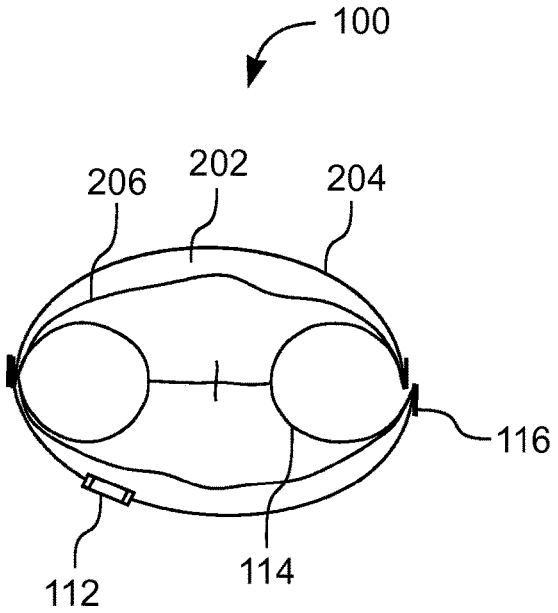
FIG. 2 is a cross sectional view of the warming garment of FIG. 1.

FIG. 2 illustrates a cross sectional view of one embodiment of the garment 100. The garment 100 includes a chamber 202 defined by the space between an outer portion 204 of fabric and an inner portion 206 of fabric. The anterior section of the outer portion 204 of the garment 100 includes a port 112. The chamber 202 is configured to receive a gas, such as forced heated air, through the port 112. When a gas is forced into the chamber 202 through the port 112, the chamber 202 expands up to its available volume as the gas flows throughout the chamber 202.

In one embodiment, the chamber 202 is formed from the outer portion 204 and at least one inner portion 206 of fabric. In one such embodiment, the inner portion 206 is configured such that the chamber 202 extends throughout the inside of the garment 100. Such a chamber 202 is formed of fabric that fits within both leg portions 106 and the waist portion 104 of the garment 100. In another embodiment, the chamber 202 is formed from an inner portion 206 that includes multiple flow channels.

In one embodiment, the chamber 202 extends distally from the waist hem 108, through the leg portions 106, to the leg hems 114 of the garment 100. In one such embodiment, the air chamber 202 provides flow between the anterior and posterior portions of the chamber 202 through the crotch area of the garment 100.

In the illustrated embodiment, the anterior portion of the chamber 202 is separate from the posterior portion of the chamber 202 at each releasable opening 116 along the lateral edges of the garment 100. In such an embodiment, there is no flow path between the anterior and posterior portions of the chamber 202 at the lateral edges of the garment 100. In another embodiment, the releasable openings 116 extend for only a portion of the length of the garment 100. In such an embodiment, flow paths are provided between the anterior and posterior portions of the chamber 202.

Figure 3:
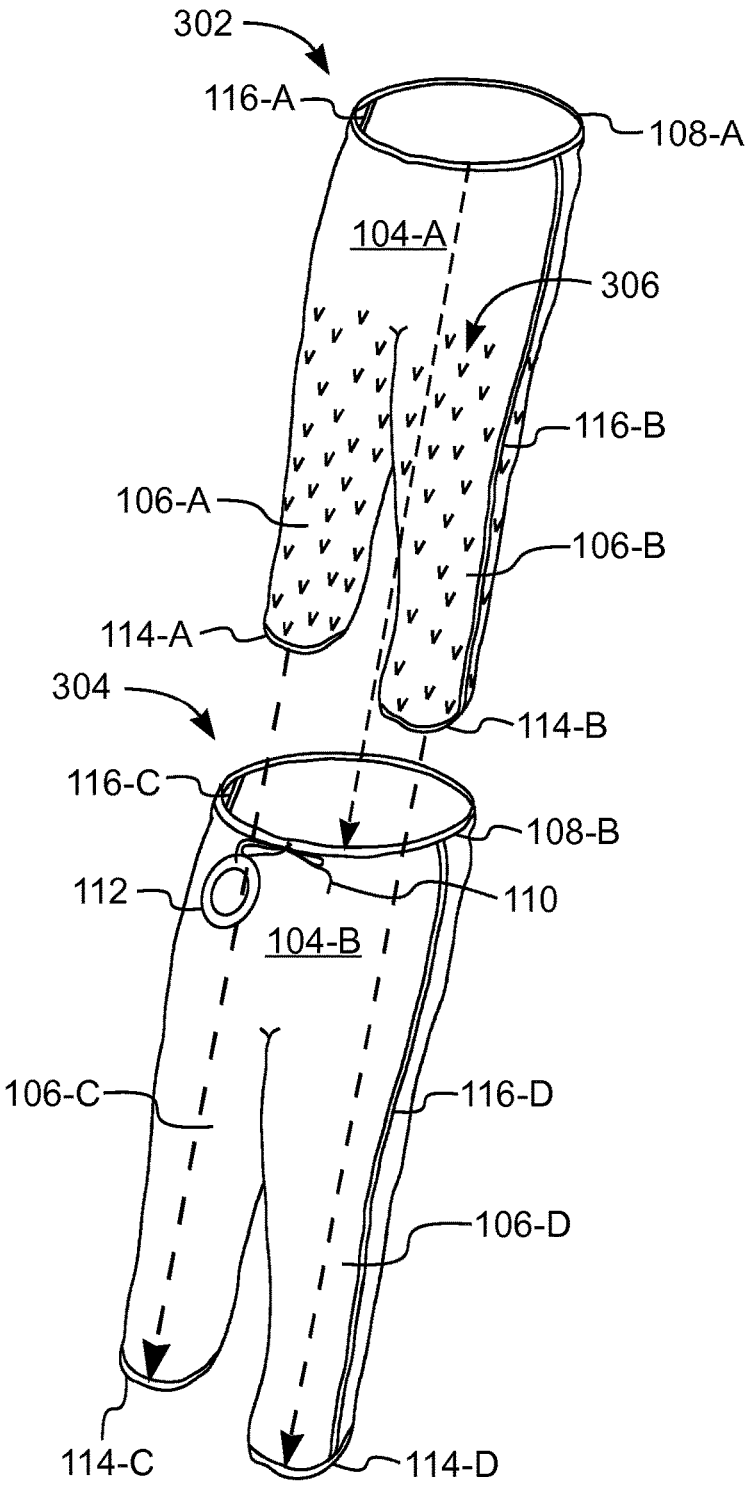
FIG. 3 is an exploded perspective diagram showing one embodiment of the warming garment as in FIG. 1.

FIG. 3 is an exploded perspective diagram illustrating one embodiment of the garment 100. The garment 100 includes a chamber 202, an inner section 302 of fabric, and an outer section 304 of fabric. The chamber 202 is defined by an inner section 302 within an outer section 304. The outer section 304 conforms substantially to the description of the garment 100 above. The inner section 302 does not include a port 112, but otherwise conforms to the description of the garment 100.

In one embodiment of the inner section 302 of the garment 100, each leg portion 106-A, 106-B includes a plurality of perforations 306, such as triangular, or V-shaped, slits in the fabric. Such slits form a V-shaped flap that allows a gas, such as air, to flow through the flap. In another embodiment, each leg portion 106-A, 106-B of the inner section 302 is an air permeable material, such as a non-woven fabric or melt blown polypropylene. In such embodiments, the warmed air flows directly to the legs to provide convective heating. The remainder of the chamber 202 provides conductive heating within the garment 100.

In one embodiment, the inner section 302 and the outer section 304 are joined at their respective perimeters to define the chamber 202. In such an embodiment, the inner section 302 and the outer section 304 are joined at the waist hems 108, the leg hems 114 at the distal ends of the leg portions 106, and at the releasable openings 106 at the lateral edges of the leg portions 106. In one such embodiment, the waist portion 104-A and leg portions 106-A, 106-B of the inner section 302 fit within the respective waist portion 104-B and leg portions 106-C, 106-D of the outer section 304.

The waist hem 108-B of the outer section corresponds to the waist hem 108-A in the inner section 302 of the garment 100. The waist hem 108-B of the outer section 304 is joined to the waist hem 108-A of the inner section 302 so that the opening in the outer section 304 corresponds to the opening in the inner section 302. Joined together, the waist hems 108-A, 108-B define an opening in the waist region of the garment 100. The waist hems 108-A, 108-B are joined together to form an air tight seal. In one embodiment, the waist hems 108-A, 108-B are fastened together via heat welding. In another embodiment, the waist hems 108-A, 108-B are fastened together via gluing.

Each leg hem 114-C, 114-D for the outer section 304 is joined to the corresponding leg hems 114-A, 114-B of the inner section 302. That is, leg hem 114-C is joined to leg hem 114-A and leg hem 114-D is joined to leg hem 114-B. The leg hems 114-C, 114-D of the outer section 304 are joined to the corresponding leg hems 114-A, 114-B of the inner section 302 to form an air tight seal at the distal end of each leg portion 106. In one embodiment, the leg hems 114 are fastened together via heat welding. In another embodiment, the leg hems 114 are fastened together via gluing.

The anterior and posterior portions of each releasable opening 116-C, 116-D of the outer section 304 are joined to the corresponding anterior and posterior portions of each releasable opening 116-A, 116-B of the inner section 302 to form an air tight seal. In one embodiment, the corresponding releasable openings 116 are fastened together via heat welding. In another embodiment, the corresponding releasable openings 116 are fastened together via gluing.

The inner section 302 is secured to the perimeter of the outer section 304 of the garment 100. In one embodiment, the inner section 302 is secured to the outer section 304 at the corresponding waist hems 108, the corresponding leg hems 114 and the corresponding releasable openings 116. In one such embodiment, the crotch areas of the inner section 302 and the outer section 304 are not joined. This provides for flow between the anterior and posterior portions of the chamber 202. In such an embodiment, the garment 100 includes a chamber 202 between the inner section 302 and the outer section 304. The chamber 202 receives a gas, such as heated air, through the port 112. The gas flows throughout the chamber 202 and is exhausted via the inner section 302 to the legs of the patient 102.

In another embodiment, the inner section 302 is not congruent with the outer section 304. For example, the inner section 302 is smaller dimensionally than the outer section 304. In one such embodiment, the waist portion 104-A of the inner section 302 is shorter than the waist portion 104-B of the outer section 304. The hem 108-A of the inner section 302 does not mate with the hem 108-B of the outer section 304, but the hem 108-A is attached medially to the waist portion 104-B of the outer section 304 to form an air tight seal. The waist portion 104-B of the outer section 304 extends past the waist portion 104-A of the inner section 302 and is secured around the patient's waist. In another such embodiment, the leg portions 106-A, 106-B of the inner section 302 are shorter than the corresponding leg portions 106-C, 106-D of the outer section 302. The leg hems 114-A, 114-B are attached medially to the corresponding leg portions 106-A, 106-B of the outer section 304 to form air tight seals. For example, the embodiment of the garment 100-B illustrated in FIG. 6 has an outer section 304 that covers a portion of the torso and includes shoulder straps 606-A. The inner section 302 for such an embodiment of the garment 100-B in one embodiment is as illustrated in FIG. 3 with the inner hem 108-A attached between the waist portion 104-C and the elongated portion 104-D.

In yet another embodiment, the inner section 302 is secured to the outer section 304 at locations medially between the edges of the two sections 302, 304. In this way, channels are formed in the chamber 202. The channels in various embodiments direct the air in the chamber 202 and/or restrict the inflatable volume of the chamber 202 to specific locations.

Figure 4:
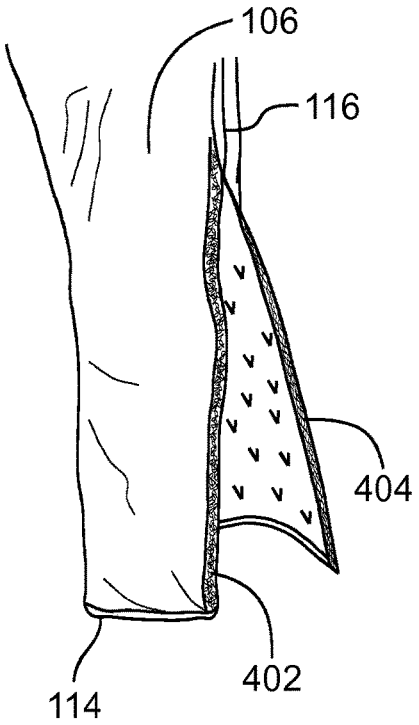
FIG. 4 is a perspective view of one embodiment of a releasable opening for the warming garment of FIG. 3.

FIG. 4 is a perspective diagram illustrating a partially open releasable opening 116 along one leg 106 of the garment 100. The lateral portion of each leg portion 106 of the garment 100 has such a releasable opening 116. The releasable opening 116 is secured via fasteners 402, 404 at the anterior and posterior sections of each respective leg portion 106. In the illustrated embodiment, the fasteners 402, 404 include adhesive tape that extends the length of the releasable opening 116. In other embodiments, the fasteners include zippers, hook and loop fasteners, straps, buttons, snaps, and/or connectors that releasably secure the anterior portion of each leg portion 106 to the posterior portion of the respective leg portion 106. In one embodiment, the fasteners 402, 404 extend for separate portions of the releasable opening 116.

In the illustrated embodiment, the releasable opening 116 is partially opened and shows the perforations 306 on the inner section 302 of the garment 100.

Figure 5:
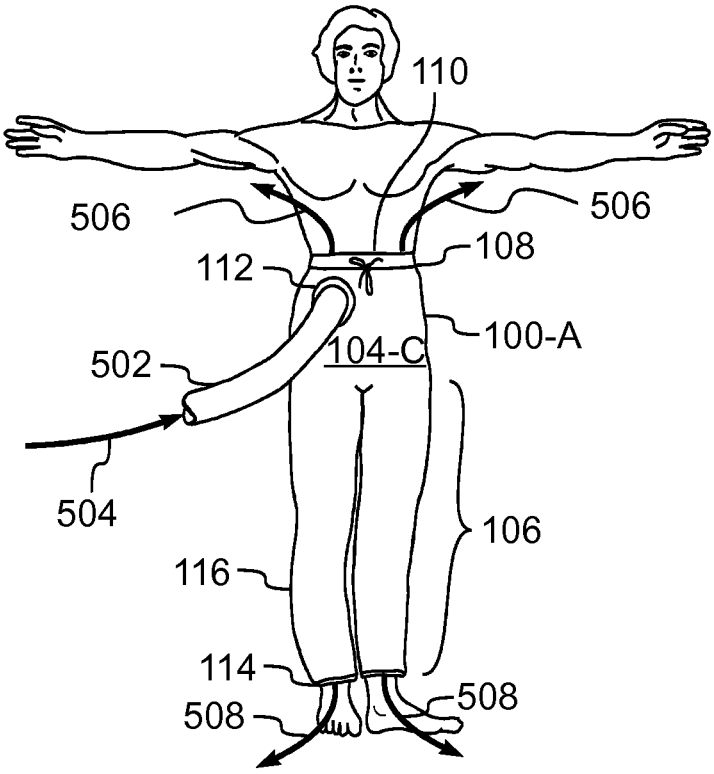
FIG. 5 is an illustration of one embodiment of a warming garment.

FIG. 5 illustrates an embodiment of a garment 100-A in an active configuration with a patient 102 wearing the garment 100-A. In the illustrated embodiment, the garment 100-A is pants. The pants 100-A conform substantially to the description of the garment 100 described above. In the illustrated embodiment, the waist portion 104-C extends from proximate the waist region to the legs of the patient 102 and does not enclose the thorax region. The garment 100-A has openings at the waist hem 108 and the leg hems 114. The garment 100-A is also adjustably openable along the releasable openings 116 of the leg portions 106. In one embodiment, the garment 100-A includes a chamber 202 that extends substantially throughout the inside of the garment 100-A.

In the active configuration, a hose 502 is connected to the port 112 of the garment 100-A. A gas 504, such as heated forced air, is provided to the hose 502 by a blower (not illustrated). The air 504 enters the chamber 202 through the port 112. As air 504 is forced into the chamber 202, the chamber 202 expands and exhausts the air 504 convectively in the leg portions 106. Conductive heating is provided in the waist portion 104-C. In this way, active heating is provided throughout the garment 100-A. The active configuration is suitable for a patient 102 before, during, and/or after surgery or other medical procedure. With a portable supply connected to the hose 502, the active configuration of the garment 100-A does not hinder patient 102 mobility.

As air is forced into the chamber 202, the chamber 202 expands. The air from the chamber 202 is exhausted into the volume defined by the inner section 302. As air flows into the pants 100-A, the air is exhausted through the waist opening via waist flow 506, and through the openings at the leg hems 114 via leg flow 508.

Waist flow 506, is dependent on the type fastener 110 and also how tightly the fastener 110 secures the waist hem 108 around the waist of the patient 102. For example, an elastic fastener 110 secures the waist opening very snugly and closes off a substantial portion of the waist flow 506, so that very little air 504 escapes at the waist of the patient 102. A drawstring fastener 110 is adjustable to be loose or even untied so that the waist opening is as loose as is possible in the particular circumstances. A loose-fitting waist results in increased waist flow 506. In various embodiments, different fasteners 110 are used to provide varying degrees of adjustability in the waist flow 506.

Waist flow 506 is also affected by the waist size of the patient 102. For example, a large waist on some patients 102 relative to the size of the hem 108 significantly limits the waist flow 506 even when the fastener 110 is adjusted as open as possible for the particular size garment 100-A. Similarly, a very small waist on some patients 102 causes difficulty in limiting the waist flow 506 even when the fastener is adjusted as snugly as possible for the particular patient 102 and size garment 100-A.

Air exiting the pants 100-A is adjustable so that both waist flow 506, and leg flow 508 are independently controlled via the respective openings. In this way, control is provided for the warming of the legs and for the air that escapes from the garment 100-A.

The pants 100-A are not typically used in isolation, however. In one embodiment, the pants 100-A are utilized for surgery or other medical procedure involving the upper body, such as the head, thorax, or arms. In such embodiments, a surgical drape or blanket covers the patient 102. In this way, a cavity or enclosed area is created which covers the thorax and/or other body portions. When more heat is necessary in the thorax or other upper body region, the waist flow 506 is increased via adjusting or otherwise opening the fastener 110. In this way, more warmed air exits the pants 100-A via waist flow 506. When less heat is necessary, the waist flow 506 is decreased by adjusting or otherwise closing the fastener 110.

Leg flow 508, is adjustable via the leg hems 114 and also via the releasable openings 116 on each lateral portion of the leg portions 106. Increasing the air exiting the pants 100-A through leg flow 508 reduces the amount of air available for waist flow 506. Conversely, the waist flow 506 is increased by reducing the leg flow 506 exiting the pants 100-A. For example, elastic leg hems 114 secure the leg openings very snugly and close off a substantial portion of the leg flow 508. Other type leg hems 114, such as drawstrings or hook and loop fasteners, for example, provide for adjustability in providing varying amounts of closure for the leg opening. In this way, the leg flow 508 is adjustable to provide for a desired level of air escaping through the leg portions 106.

Leg flow 508 is also adjustable by opening or closing the releasable openings 116 of each leg portion 106 of the garment 100-A. In various embodiments, the fasteners 402, 404 are adjustable to be open, closed, or partially open along the length of the releasable openings 116.

Figure 6:
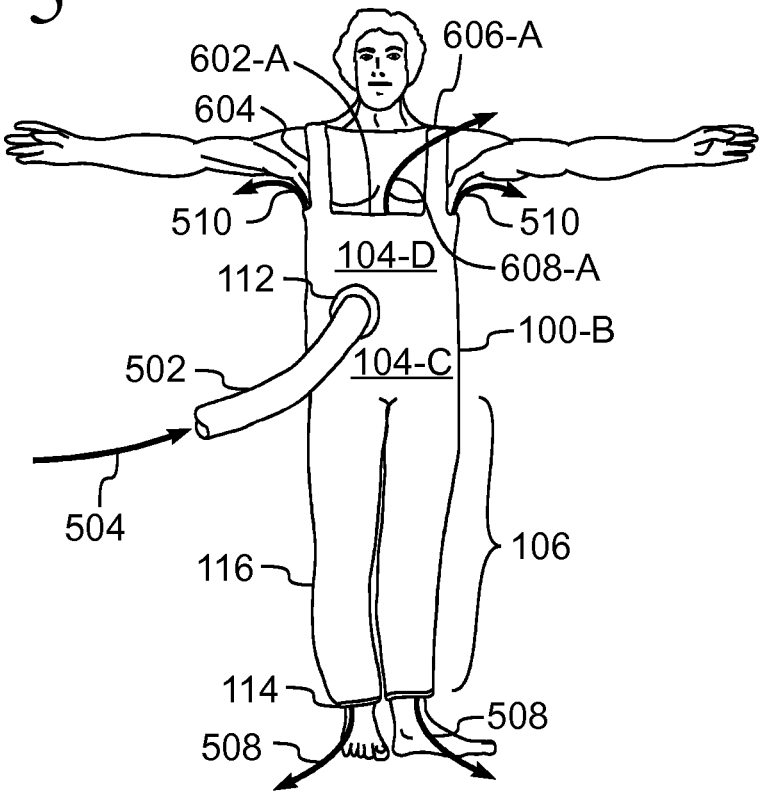
FIG. 6 is an illustration of a second embodiment of a warming garment.

FIG. 6 illustrates another embodiment of the garment 100-B in an active configuration. In the illustrated embodiment, the garment 100-B includes shoulder straps 606-A and an elongated portion 104-D extending from the waist portion 104-C. Otherwise, the waist portion 104-C and the leg portions 106 are substantially as described above with reference to the pants 100-A. The shoulder straps 606-A extend from the anterior portion of the thorax opening 602-A of the elongated portion 104-D, across the shoulders, and attach to the posterior portion of the thorax opening 602-A. The elongated portion 104-D, and thus the garment 100-B, is supported by the shoulder straps 606-A with the patient 102 in a standing position.

The elongated portion 104-D is an extension of the waist portion 104-C. Due to this extension, the garment 100-B encloses a portion of the thorax while retaining accessibility to the upper chest, head, neck, and arms of the patient 102. In one embodiment, the elongated portion 104-D and the waist portion 104-C are formed from the same fabric. In other embodiments, the elongated portion 104-D is a separate material joined to the waist portion 104. In one such embodiment, the elongated portion 104-D and the waist portion 104-C are fastened together via heat welding. In another embodiment, the elongated portion 104-D and the waist portion 104-C are fastened together via gluing. In some such embodiments, a waist hem 108 defines a border between the elongated portion 104-D and the waist portion 104-C.

The elongated portion 104-D and the shoulder straps together 606-A define a thorax opening 602-A and two arm openings 604. The thorax opening 602-A is in the thorax, or chest, region proximate the underarm area of the patient 102. The garment 100-B includes two openings at the leg hems 114 which are substantially as described with reference to garment 100-A above. The garment 100-B is also adjustably openable along the releasable openings 116 of the leg portions 106.

In one embodiment, the garment 100-B includes a chamber 202 that extends from the waist portion 104-C, through the leg portions 106, and to the leg hems 114. For such an embodiment, the chamber 202 is substantially as described above with respect to the pants 100-A and does not extend into the elongated portion 104-D. For example, the inner section 302 is as described in FIG. 3 above and the hem 108-A is attached to waist portion 104-C. In another embodiment, the chamber 202 extends into the elongated portion 104-D. That is, the garment 100-B includes a chamber 202 that extends substantially throughout the inside of the garment 100-B. In such an embodiment, the chamber 202 extends distally from the thorax opening 602-A, through the elongated portion 104-D, through the waist portion 104-C, through the leg portions 106, to the leg hems 114.

Air 504 is forced into the chamber 202 as above. As air is exhausted from the chamber 202, the garment 100-B expands and the legs are warmed convectively. The waist region is warmed conductively via the waist portion 104-C. In some embodiments, the thorax region is also warmed conductively by the elongated portion 104-D. As air exits the chamber 202, it flows throughout the remainder of the garment 100-B. The air exits the garment 100-B through the thorax opening 602-A via the thorax flow 608-A, and via arm flow 510 through the arm openings 604. The elongated region 104-D of the garment 100-B is less restrictive around the thorax region than the pants 100-A are around the waist region of the patient 102. This reduced restriction provides increased thorax flow 608-A and arm flow 510. This increases the flow exiting the garment 100-B. In this way, increased warming of the thorax region of the patient 102 is provided by the garment 100-B.

The air exiting the garment 100-B via thorax flow 608-A and arm flow 510 is also increased by closing off the leg flow 508 as discussed above. Conversely, increasing the leg flow 508 reduces the amount of air exiting the garment 100-B via thorax flow 608-A and arm flow 510.

The increased coverage of the thorax region in the garment 100-B provides thorax flow 608-A and arm flow 510 through the thorax region. In this way, more warm air is confined in a close region to the patient 102 than for either a gown or a blanket.

In some instances, the size of the stomach or thorax region of a larger patient 102 alters the exit flow from the garment 100-B. In those instances, the size of the patient 102 is such that the thorax opening 602-A and arm openings 604 are partially or completely closed off and the garment 100-B retains even more warm air than if it were less restricted.

As with the pants 100-A, the garment 100-B is not typically used in isolation. In various embodiments, the garment 100-B is utilized for surgery or other medical procedures. In such embodiments, a surgical drape or blanket covers at least part of the patient 102. In this way, a cavity or enclosed area is created which covers the patient 102. The garment 100-B confines a portion of warm air in close proximity to the patient 102. This warming effect provides for placement of the surgical drape or blanket in those areas not directly warmed by the garment 100-B.

Figure 7:
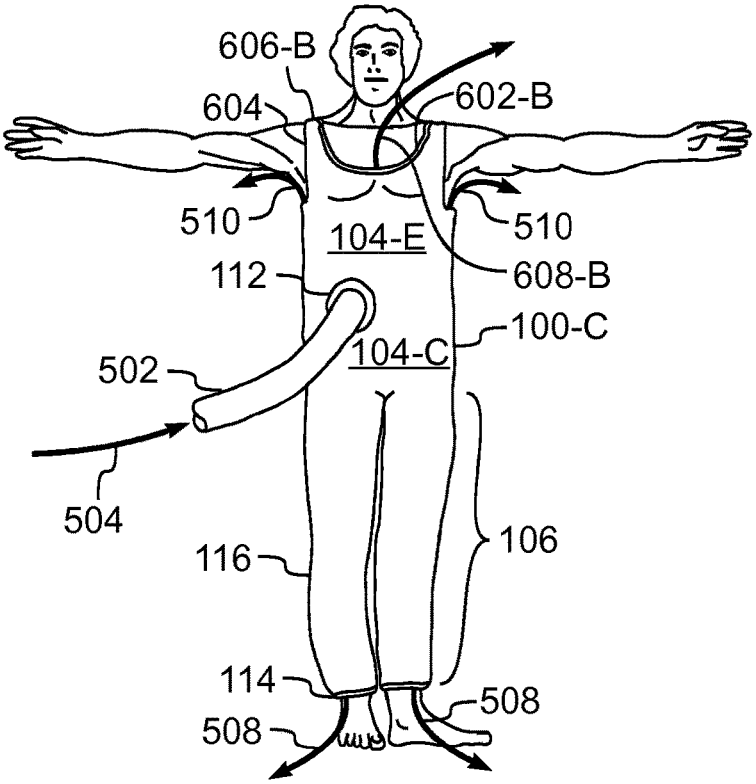
FIG. 7 is an illustration of a third embodiment of a warming garment.

FIG. 7 illustrates another embodiment of the garment 100-C in an active configuration. In the illustrated embodiment, the garment 100-C includes shoulder straps 606-B and an elongated portion 104-E extending from the waist portion 104-C. The shoulder straps 606-B and the elongated portion 104-E combine to form a thorax opening 602-B in the anterior thorax region proximate the neck. The opening extends similarly in the posterior thorax region of the garment 100-C. The thorax opening 602-B is smaller than the thorax opening 602-A described above in respect to the garment 100-B.

As above, the elongated portion 104-E is an extension of the waist portion 104-C. Due to this extension, the garment 100-C encloses the legs and a portion of the thorax while retaining accessibility to the head, arms, neck, and a portion of the chest of the patient 102. In comparison to the garment 100-B, the thorax opening 602-B is reduced in size so that the elongated portion 104-E covers a larger portion of the thorax region. Otherwise the waist portion 104-C and the leg portions 106 of the garment 100-C are substantially as described above with reference to the pants 100-A and the garment 100-B.

The thorax region is more enclosed by the elongated region 104-E than by the elongated region 104-D discussed above. For this reason, the thorax flow 608-B exiting at the thorax opening 602-B is more restricted by comparison. Thorax flow 608-B is slightly restricted compared with thorax flow 608-A, which results in slightly less air flow 608-B and increased pressure in the chamber 202 unless leg flow 508 is increased. As above, adjustments to air flow can also be made by increasing or decreasing leg flow 508, as appropriate. The increased coverage of the thorax region in the garment 100-C over the garment 100-B provides for confining more warm air in a close region to the patient 102 than the garment 100-B, a gown, or a blanket.

As above, the size of larger patients 102 alters the exit flow from the garment 100-C so that the thorax opening 602-B and arm openings 604 are partially or completely closed off. In such situations, the garment 100-C retains even more warm air than described above.

As described above, the garment 100-C is sometimes utilized for surgery or other medical procedures. The warming effect of the garment 100-C provides for placement of a surgical drape or blanket in those areas not directly warmed by the garment 100-C.

Figure 8:
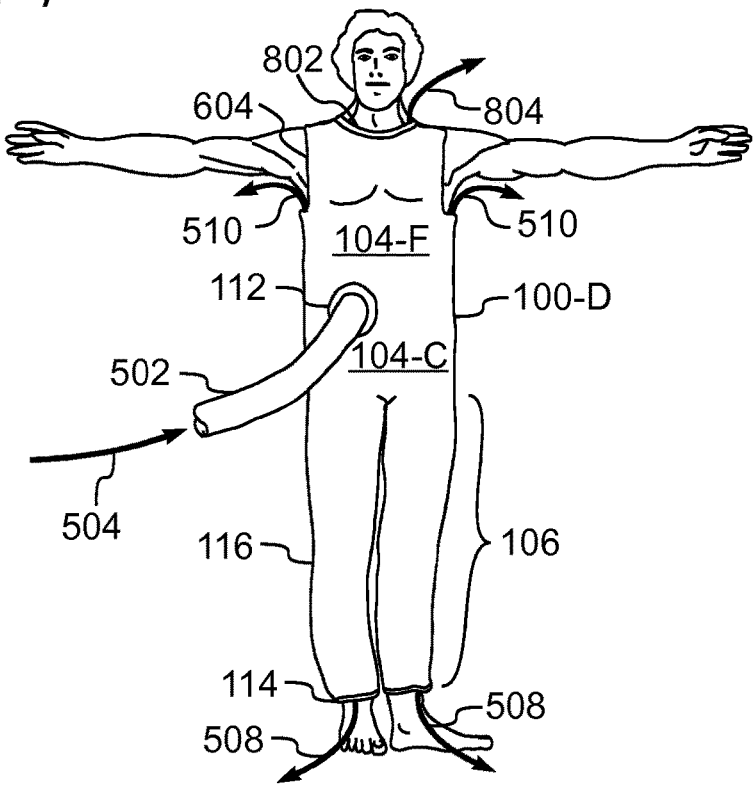
FIG. 8 is an illustration of a fourth embodiment of a warming garment.

FIG. 8 illustrates another embodiment of the garment 100-D in an active configuration. In the illustrated embodiment, the garment 100-D includes a neck opening 802 and an elongated portion 104-F that extends from the waist portion 104-C. The neck opening 802 in the elongated portion 604-D is such that essentially the entire thorax, or chest, region of the patient 102 is enclosed. The elongated portion 104-F includes two arm openings 510.

As above, the elongated portion 104-F is an extension of the waist portion 104-C. The elongated portion 104-F is such that the garment 100-D encloses the legs, waist, and thorax while retaining accessibility to the head, neck and arms of the patient 102. In comparison to the garments 100-B, 100-C the neck opening 802 is smaller than the thorax openings 602-A, 602-B so that the elongated portion 104-F encloses the entire thorax region. Otherwise the waist portion 104-C and the leg portions 106 of the garment 100-D are substantially as described above with reference to the garments 100-A, 100-B, 100-C.

The thorax region is entirely enclosed by the elongated region 104-F. For this reason, the neck flow 804 exiting at the neck opening 802 is reduced by comparison with the thorax openings 608-A, 608-B described above. Similarly, the arm flow 510 is also reduced. For an otherwise similar configuration, the air flow exiting garment 100-C is reduced in comparison to the air flow exiting the garments 100-B, 100-C described above. As above, adjustments to air flow can also be made by increasing or decreasing leg flow 508, where appropriate.

The complete enclosure of the thorax region in the garment 100-D over the garments 100-B, 100-C provides for confining more warm air in a region close to the patient 102 than either the garments 100-B, 100-C, a gown, or a blanket.

As above, the size of larger patients 102 alters the exit flow from the garment 100-D so that the neck opening 802 and arm openings 604 are partially or completely closed off. In such situations, the garment 100-D retains even more warm air than described above.

As also described above, the garment 100-D is sometimes utilized for surgery or other medical procedures. The warming effect of the garment 100-D with complete thorax enclosure provides for placement of a surgical drape or blanket in those areas not directly warmed by the garment 100-D.

Figure 9:
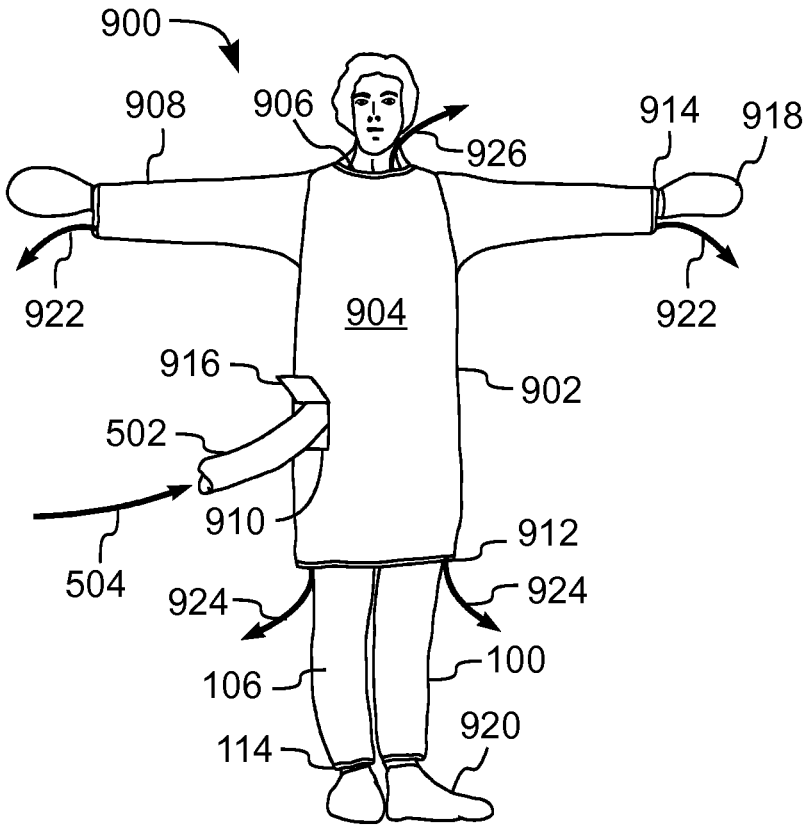
FIG. 9 is an illustration of a warming system including a warming garment and a gown.
Figure 10:
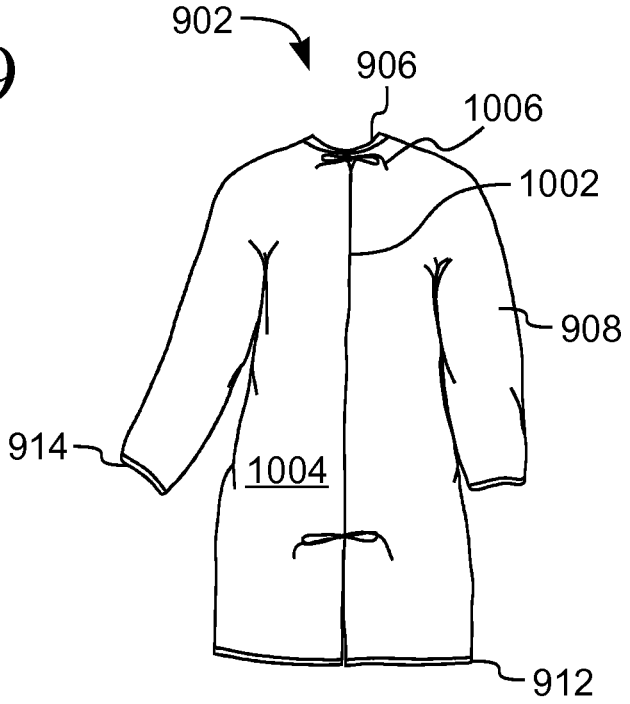
FIG. 10 is a posterior view of a gown as in FIG. 9.

FIG. 9 illustrates an embodiment of a warming system 900. The system 900 includes a garment 100, a gown 902, hand enclosures 918, and foot enclosures 920. FIG. 10 illustrates a posterior view of the gown 902. FIG. 9 shows the garment 100 and gown 902 in an active configuration, with a hose 502 attached. The system 900 is suitable for a patient 102 before, during, and/or after surgery or other medical procedure. With a portable supply connected to the hose 502, the active configuration of the system 900 does not hinder patient 102 mobility.

The gown 902 includes a body 904 and a pair of sleeves 908. The body 904 extends distally toward the feet of the patient 102 to a body opening 912. The legs of the patient 102 extend through the body opening 112. The body 904 of the gown 902 is sized and configured to fit loosely around the thorax and waist of the patient 102. The body 904 of the gown 902 encloses the thorax and the waist by encircling the patient's body. The body 904 has an opening 906 through which the neck of the patient 102 extends. With the patient 102 upright, such as when standing or sitting, the gown 902 is supported by resting on the shoulders of the patient 102.

The gown 902 includes an anterior opening 910. The anterior opening 910 corresponds to the port 112 of the garment 100. The anterior opening 910 includes a cover 916. In one embodiment, the cover 916 is a flap 916. The flap 916 is open to provide access to the anterior opening 910. In another embodiment, the anterior opening 910 includes a slit in the outer surface of the gown 902 with the hose 502 passing through the slit. A portion of the grown 902 overlaps a portion of the garment 100 such that the anterior opening 910 overlaps the port 112 of the garment 100. The anterior opening 910 provides access to the port 112 of the garment 100. In the illustrated embodiment, a hose 502 extends through the anterior opening 910 and is attached to the port 112. In a passive configuration, a hose 502 is not present.

The pair of sleeves 908 extend from the body 904 of the gown 902. In one embodiment, the sleeves 908 have a length that is sufficient to enclose the arms of the patient 102 from the shoulders to the wrists of the patient 102. The hands of the patient 102 extend through an opening 914 distal from the shoulders of the patient 102. In another embodiment, the sleeves 908 have a longer length that is sufficient to also enclose the hands of the patient 102. In such an embodiment, the hands, including the fingers of the patient 102, are contained inside the sleeves 908 and subject to the warming effects of the gown 902. In another embodiment, hand enclosures 918 are included to enclose the hands of the patient 102. In various embodiments, the hand enclosures 918 include mittens, gloves, and the like.

The gown 902 encloses the thorax and waist of the patient 102 front to back. The gown 902 has a posterior opening 1002 that extends from the neck opening 906 to the body opening 912. The posterior opening 1002 is formed from a pair of flaps 1004. The pair of flaps 1004 are the posterior portion of the gown 902 and extend from the neck opening to the body opening 912. The posterior opening 1002 is partially closed by joining the edges of the pair of flaps 1004 at one or more locations. In one embodiment, the flaps 1004 are joined or connected by straps 1006, on each flap 1004. A first pair of straps 1006 closes the neck opening 906 of the gown 902, and a second pair of straps 1006 closes a second location medial to the gown 902. In other embodiments, the flaps 1004 are joined or connected by string, buttons, snaps, hook and loop fasteners, and/or connectors that releasably secure the flaps 1004 together.

In one embodiment, the gown 902 is made of a non-woven material that is air permeable. In one such embodiment, the material is bio-degradable. In one embodiment, the sleeves 908 and the posterior portion of the body 904 are heat reflective or include a material that is heat reflective. This heat reflective material provides passive warming when heated air is forced into those portions of the gown 902. The anterior portion of the gown 902 in the thorax region does not include the heat reflective material. The heat reflective material has a low emissivity such that the heat proximate the patient 102 is not substantially reflected or radiated away from the patient 102, which tends to prevent cooling of the patient 102 by heat radiation losses.

In another embodiment, foot enclosures 920 are provided to enclose the feet of the patient 102. In various embodiments, the foot enclosures 920 include medical footwear, nursing shoes, footies, and the like.

When heated air is supplied to the inside of the garment 100, the heated air flows throughout the garment 100 and air flows, such as waist flow 506, arm flow 510, thorax flow 608, and/or neck flow 804, are exhausted from the garment 100 into the gown 902. Air that is exhausted into the gown 902 provides warming to the patient 102. Air flow exits the gown via neck flow 926 through the neck opening 906. Air flow exits the gown via arm flow 922 through the arm openings 914. Air flow exits the gown via body flow 924 through the body opening 912. The amount of air flow in each instance is dependent on which garment 100 is utilized with the gown 902.

In operation, a patient 102 is outfitted with garment 100 prior to surgery or some other medical procedure. This typically occurs with the patient 102 in a standing position. A hose 502 is not connected to the port 112. The patient 102 is free to walk around or sit as the need arises while waiting for the procedure to begin. The garment 100 is in the passive configuration because warming is accomplished passively by the material of the garment 100.

For the active configuration, the patient 102 is typically situated in a restricted mobility position by being tethered to the hose 502. The nozzle of a hose 502 is inserted through the port 112 of the garment 100. Heated, forced air is generated by a blower attached to the hose 502. To prevent unintended cooling of the patient 102, the temperature of the air from the blower is typically adjusted to a range from 36-43° C.

The heated air 504 enters the garment 100 from the hose 502. As the heated air 504 enters the garment 100, the chamber 202 expands. The heated air 504 is exhausted by the chamber 202 into the remainder of the garment 100. For the pants 100-A, the heated air leaves the garment 100 through the waist opening 108 and the openings at the leg hems 114.

When the pants 100-A are used in combination with a covering for the patient 102, such as a surgical drape or blanket, an enclosed area is created over the thorax and/or other portions of the patient 102. The warming effects of the pants 100-A provide for placement of a surgical drape or gown 902 in those areas not directly warmed by the pants 100-A. Additional warming is provided in the area under the drape by increasing the flow of air exiting the waist and/or the legs. The air flow is adjusted from the waist by opening or closing the fastener 110 as necessary. Similarly, the air flow is adjusted from the legs by opening and/or closing the leg hems 114 or the releasable openings 116 as necessary.

In other embodiments of the garment 100-B, 100-C, 100-D air flow through the thorax region is increased in comparison with the pants 100-A. The amount of warm air retained in very close proximity to the patient 102 is variable and adjustable by selecting a particular garment 100-B, 100-C, 100-D, and/or by adjusting the flow within the selected garment 100-B, 100-C, 100-D. The air flow is partially adjusted from the legs by opening and/or closing the leg hems 114 or the releasable openings 116 as necessary.

Each elongated portion 104-D, 104-E, 104-F of the respective garments 100-B, 100-C, 100-D encloses progressively more of the thorax than the previously discussed embodiments while also maintaining access to at least a portion of the upper body of the patient 102. The garments 100-B, 100-C, 100-D provide direct warming to the thorax of the patient 102. Additional warming is provided for by placement of a surgical drape or blanket in areas not directly warmed by the garment 100-B, 100-C, 100-D.

Air temperature is maintained at a desired level for the legs, and the core to peripheral temperature gradient is reduced. The core to peripheral temperature gradient is the difference in temperature between the core region of the patient 102, that is, the chest or thorax, and the extremities, such as the legs. The difference in temperature between the thorax region and the legs is minimized. The air temperature of the patient 102 is maintained within the garment 100 before, during, and/or after surgery or any other medical procedure.

When the gown 902 is used, the warming system 900 includes both the garment 100 and the gown 902. The system 900 is operable for the gown 902 in combination with each of the above described embodiments of the garment 100-A, 100-B, 100-C, 100-D. As above, the patient 102 is free to walk around or sit as the need arises while waiting for the procedure to begin with the garment 100 in the passive or active configuration.

With no hose 502 connected, the system 900 is in the passive configuration. The passive heating properties of the gown 902 come into play. The reflective materials of the sleeves 908 and the anterior portion of the body 904 of the gown 902 reduce the loss of the body heat of the patient 102. The anterior portion of the body of the gown 902 in the thorax region has no heat reflective material and the body heat generated by the patient's torso is radiated through the anterior portion of the body 904 of the gown 902. In this way, the gown 902 prevents redistribution hypothermia when the patient 102 is mobile.

In the active configuration, air 504 is forced into the garment 100. The nozzle of a hose 502 is inserted through the anterior opening 910 of the gown 902 into the port 112 of the garment 100.

The heated, forced air 504 enters the chamber 202 of the garment 100. The chamber 202 exhausts the air into the garment 100 as above. The garment 100 provides active heating to the patient 102 as described above for the particular embodiment of the garment 100-A, 100-B, 100-C, 100-D. For the pants 100-A, the heated air leaves gradually through the waist opening and/or openings in the leg portions 106. As the air exits the pants 100-A, it flows into and throughout the gown 902. Passive heating is provided to the patient 102 by the reflective materials of the gown 902. The heated air gradually leaves the gown 902 through the neck opening 906, the body opening 904, and the arm openings 914.

In other embodiments, air flow through the thorax region of the garment 100-B, 100-C, 100-D is increased relative to that provided by the pants 100-A. In each instance, progressively increased warming is achieved in the thorax region. As discussed above, the amount of warm air retained in very close proximity to the patient 102 is adjustable by selecting a particular garment 100-B, 100-C, 100-D and/or by adjusting the flow within that garment 100 as necessary.

In embodiments with or without the gown 902, air temperature is maintained at a desired level for the legs, and the core to peripheral temperature gradient is reduced. That is, the difference in temperature between the chest or thorax region and the legs is minimized. The air temperature of the patient 102 is maintained within the garment 100 before, during, and/or after surgery or any other medical procedure. In this way, redistribution hypothermia is prevented in the arms and legs while the patient 102 is undergoing surgery or other medical procedures.

From the foregoing description, it will be recognized by those skilled in the art that systems and methods for providing a garment 100 with both passive and active warming are presented.

While the present invention is illustrated by description of several embodiments and the illustrative embodiments are described in considerable detail, applicant does not intend to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A system configured to warm a patient to prevent redistribution hypothermia, comprising:

a garment configured to cover a lower body portion of the patient, the garment including:

a pair of leg portions, each leg portion having a leg flow configured to move air in a direction downward from the pair of leg portions;

a waist portion having a waist flow configured to move air in a direction upward from the waist portion;

a first surface that is air permeable and proximate the patient when the patient is wearing the garment, each of the pair of the leg portions having a plurality of perforations along the first surface;

a second surface that is air impermeable and, being an outside surface of the garment;

an air chamber formed between the first surface and the second surface, the air chamber dimensioned and shaped to expand as air is supplied to the garment; and an inlet port penetrating the air chamber, wherein when an air hose is connected to the inlet port the air chamber is configured to receive conditioned air, the conditioned air being provided to the air chamber at a temperature of at least 36 degrees celsius, and each of the pair of leg portions dimensioned and shaped to provide convective heating directly to legs of the patient, and the waist portion dimensioned and shaped to provide conductive heating within the garment; and a gown configured to cover an upper body portion of the patient and having a length sufficient to create an overlap portion that overlaps the waist portion of the garment when the garment and the gown are worn by the patient, the gown having an opening through the overlap portion from an exterior side to an interior side of the gown, the opening being dimensioned and shaped to accommodate the air hose when the air hose is connected to the inlet port.

2. The system of claim 1, wherein the garment includes at least one releasable opening extending along at least one of the pair of leg portions, wherein the at least one releasable opening is configured to provide access to the patient through the garment when worn.

3. The system of claim 1, wherein the gown includes a pair of sleeves that are heat reflective, and the gown includes an anterior portion that is not heat reflective.

4. The system of claim 1 further including a pair of hand coverings and a pair of foot coverings, the system configured to cause air exhausting the pair of leg portions and a pair of sleeves of the gown to pass into the pair of hand coverings and the pair of foot coverings, whereby the pair of hand coverings and the pair of foot coverings are configured to warm the extremities of the patient when worn.

5. The system of claim 1, wherein the opening is dimensioned and shaped to accommodate the air hose passing through the opening to thereby reach and connect to the inlet port.

6. The system of claim 1, wherein the opening is an anterior opening provided through an anterior portion of the gown adjacent an anterior aspect of the patient's body when the gown is worn by the patient.

7. The system of claim 1, wherein the waist portion is above the pair of leg portions at a top of the garment.

8. The system of claim 1, wherein the air flowing system is configured to cause in the direction upward from the waist flows into and throughout the gown.

9. The system of claim 1, wherein the system is configured to cause air flowing in the direction upward from the waits flows out of the waist portion without flowing into and throughout the gown.

10. The system of claim 1, wherein the system is configured to cause air supplied to the garment is exhausted, in part, from the garment to the gown.

11. The system of claim 1, wherein the garment corresponds to a pair of pants wearable by the patient.

12. The system of claim 1, wherein the temperature of the conditioned air ranges from 36 degrees Celsius to 43 degrees Celsius.

13. The system of claim 1, wherein the system is dimensioned and shaped to reduce a core-to-peripheral temperature gradient of the patient before, during, and/or after a medical procedure.

14. A system for warming a patient to prevent redistribution hypothermia, the system comprising:

a garment configured to cover a lower body portion of the patient and having:

a pair of leg portions;

a waist portion;

a first surface that is air permeable and proximate the patient when the patient is wearing the garment, each of the pair of the leg portions having a plurality of perforations along the first surface; and a second surface that is air impermeable and being an outside surface of the garment;

an air chamber formed between the first surface and the second surface; and an inlet port penetrating the air chamber, wherein when an air hose is connected to the inlet port the air chamber is configured to receive conditioned air, and each of the pair of leg portions is dimensioned and shaped to provide convective heating directly to legs of the patient, and the waist portion is dimensioned and shaped to provide conductive heating within the garment; and a gown configured to cover an upper body portion of the patient and, having a length sufficient to overlap the waist portion of the garment when the garment and the gown are worn by the patient, the gown having an opening through the gown from an exterior side to an interior side and that provides access to the inlet port of the garment when the garment and the gown are worn by the patient and the gown overlaps the waist portion, the opening configured and dimensioned to accommodate the air hose when the air hose is connected to the inlet port.

15. The system of claim 14, wherein the garment includes at least one releasable opening extending along at least one of the pair of leg portions, wherein the at least one releasable opening is configured to provide access to the patient through the garment when worn.

16. The system of claim 14, wherein the gown includes a pair of sleeves that are heat reflective, and the gown includes an anterior portion that is not heat reflective.

17. The system of claim 14 further including a pair of hand coverings and a pair of foot coverings, the system configured to cause air exhausting the pair of leg portions and a pair of sleeves of the gown passes into the pair of hand coverings and the pair of foot coverings, whereby the pair of hand coverings and the pair of foot coverings are configured to warm the extremities of the patient when worn.

18. A system configured to warm a patient to prevent redistribution hypothermia, comprising:

a garment configured to cover a lower body portion of the patient, the garment having:

a pair of leg portions;

a waist portion;

a first surface that is air permeable and proximate the patient when the patient is wearing the garment, each of the pair of the leg portions having a plurality of perforations along the first surface; and a second surface that is air impermeable and being an outside surface of the garment;

an air chamber formed between the first surface and the second surface; and an inlet port penetrating the air chamber, wherein when an air hose is connected to the inlet port the air chamber is configured to receive conditioned air, and each of the pair of leg portions is dimensioned and shaped to provide convective heating directly to legs of the patient, and the waist portion is dimensioned and shaped to provide conductive heating within the garment; and a gown configured to cover an upper body portion of the patient and having a length sufficient to overlap the waist portion of the garment when the garment and the gown are worn by the patient, the gown having an opening through the gown from an exterior side to an interior side and overlapping the air inlet port, and the opening being dimensioned and shaped to accommodate the air hose through the opening when the air hose is connected to the inlet port.

19. The system of claim 18, wherein the garment includes at least one releasable opening extending along at least one of the pair of leg portions, wherein the at least one releasable opening is configured to provide access to the patient through the garment when worn.

20. The system of claim 18 further including a pair of hand coverings and a pair of foot coverings, the system configured to cause air exhausting the pair of leg portions and a pair of sleeves of the gown to pass into the pair of hand coverings and the pair of foot coverings, whereby the pair of hand coverings and the pair of foot coverings are configured to warm the extremities of the patient when worn.

21. A system configured to warm a patient to prevent redistribution hypothermia, comprising:

a garment configured to cover a lower body portion of the patient, the garment having:

a pair of leg portions;

a waist portion;

a first surface that is air permeable and proximate the patient when the patient is wearing the garment, each of the pair of the leg portions having a plurality of perforations along the first surface;

a second surface that is air impermeable and being an outside surface of the garment;

an air chamber formed between the first surface and the second surface; and an inlet port penetrating the air chamber, wherein when an air hose is connected to the inlet port the air chamber is configured to receive conditioned air, and each of the pair of leg portions is dimensioned and shaped to provide convective heating directly to legs of the patient, and the waist portion is dimensioned and shaped to provide conductive heating within the garment; and a gown configured to cover an upper body portion of the patient and having a length sufficient to overlap the waist portion of the garment when the garment and the gown are worn by the patient, the gown having an opening through the gown from an exterior side to an interior side and which coincides with the inlet port when the garment and the gown are worn by the patient, the opening being dimensioned and shaped to accommodate the air hose, thereby allowing the air hose to pass through the opening and connect to the inlet port.

22. A system configured to warm a patient to prevent redistribution hypothermia, comprising:

a lower body garment having:

a pair of leg portions;

a waist portion;

a first surface that is air permeable and proximate the patient when the patient is wearing the lower body garment, each of the pair of the leg portions having a plurality of perforations along the first surface;

a second surface that is air impermeable and being an outside surface of the lower body garment;

an air chamber formed between the first surface and the second surface; and an inlet port penetrating the air chamber, wherein when an air hose is connected to the inlet port the air chamber is configured to receive conditioned air, and each of the pair of leg portions is dimensioned and shaped to provide convective heating directly to legs of the patient, and the waist portion is dimensioned and shaped to provide conductive heating within the garment; and a gown configured to cover an upper body portion of the patient and having a length sufficient to overlap the waist portion of the lower body garment when the lower body garment and the gown are worn by the patient, the gown having an opening through the gown from an interior side to an exterior side and proximate the inlet port when the lower body garment and the gown are worn by the patient, the opening being dimensioned and shaped to accommodate the air hose through the opening when the air hose is connected to the inlet port.

23. The system of claim 22, wherein the lower body garment does not extend above the waist of the patient when the lower body garment is worn by the patient.

24. A system configured to warm a patient to prevent redistribution hypothermia, comprising:

a garment configured to cover a lower body portion of the patient, the garment having:

a pair of leg portions;

a waist portion;

a first surface that is air permeable and proximate the patient when the patient is wearing the garment, each of the pair of the leg portions having a plurality of perforations along the first surface;

a second surface that is air impermeable and being an outside surface of the garment;

an air chamber formed between the first surface and the second surface; and an inlet port penetrating the air chamber, wherein when an air hose is connected to the inlet port the air chamber is configured to receive conditioned air from the air hose and configured to vent conditioned air out of the air chamber towards the feet and the waist of the patient, and each of the pair of leg portions is dimensioned and shaped to provide convective heating directly to legs of the patient, and the waist portion is dimensioned and shaped to provide conductive heating within the garment; and a gown configured to cover an upper body portion of the patient and having a length sufficient to overlap the waist portion of the garment when the garment and the gown are worn by the patient, the gown having an opening through the gown from an outer-most surface to an inner-most surface and proximate the inlet port when the garment and the gown are worn by the patient, the opening being dimensioned and shaped to accommodate the air hose through the opening when the air hose is connected to the inlet port.

25. A system configured to warm a patient to prevent redistribution hypothermia, comprising:

a garment configured to cover a lower body portion of the patient, the garment having:

a pair of leg portions;

a waist portion;

a first surface that is air permeable and proximate the patient when the patient is wearing the garment, each of the pair of the leg portions having a plurality of perforations along the first surface;

a second surface that is air impermeable and being an outside surface of the garment;

an air chamber formed between the first surface and the second surface; and an inlet port penetrating the air chamber, wherein when an air hose is connected to the inlet port the air chamber is configured to receive conditioned air, and each of the pair of leg portions is dimensioned and shaped to provide convective heating directly to legs of the patient, and the waist portion is dimensioned and shaped to provide conductive heating within the garment; and a gown configured to cover an upper body portion of the patient and having a length sufficient such that an overlap region of the gown overlaps the waist portion of the garment when the garment and the gown are worn by the patient, the gown having an opening completely through the overlap region, the opening being dimensioned and shaped to accommodate the air hose through the opening when the air hose is connected to the inlet port.

* * * * *